United States Patent [19]

Lemaire et al.

[11] Patent Number: 4,459,919

[45] Date of Patent: Jul. 17, 1984

[54] RADIAL TRUCK

[75] Inventors: Emmanuel Lemaire, Binche; Michel De Ro, Nivelles; Jacques Cuylits, Brussels, all of Belgium

[73] Assignee: S.A. Constructions Ferroviaires et Metalliques, Brussels, Belgium

[21] Appl. No.: 354,326

[22] Filed: Mar. 2, 1982

[30] Foreign Application Priority Data

Mar. 5, 1981 [LU] Luxembourg ..... 83193

[51] Int. Cl.[3] ..... B61F 3/10; B61F 3/16; B61F 5/40; B61F 5/52

[52] U.S. Cl. ..... 105/169; 105/136; 105/179; 105/180; 105/184; 105/199 R

[58] Field of Search ..... 105/157 R, 168, 169, 105/170, 174, 175 R, 165, 179, 180, 182 R, 184, 199 R, 136

[56] References Cited

U.S. PATENT DOCUMENTS

| | | | |
|---|---|---|---|
| 444,181 | 1/1881 | Robinson | 105/168 |
| 1,147,430 | 7/1915 | Pflager | 105/179 |
| 1,576,298 | 3/1926 | Barbey et al. | 105/179 |
| 2,063,545 | 12/1936 | Flowers | 105/169 X |
| 2,103,713 | 12/1937 | Dietrich | 105/169 |
| 2,168,293 | 8/1939 | Kiesel, Jr. | 105/182 R |
| 2,207,167 | 7/1940 | Stoltz | 105/179 X |
| 3,066,617 | 12/1962 | Bingham | 105/179 |
| 3,707,125 | 12/1972 | Milenkovic et al. | 105/169 X |
| 4,221,172 | 9/1980 | Sobolewski | 105/182 R X |
| 4,285,280 | 8/1981 | Smith | 105/168 |

FOREIGN PATENT DOCUMENTS

| | | | |
|---|---|---|---|
| 195611 | 3/1923 | United Kingdom | 105/179 |

*Primary Examiner*—Howard Beltran

*Attorney, Agent, or Firm*—Sughrue, Mion, Zinn, Macpeak and Seas

[57] ABSTRACT

A supporting and guiding device for railway vehicles has at least four wheels 1, 2 mounted on a support intended to be fixed to the body 3 of a vehicle near one end thereof. The device includes a cross bar 8 maintained perpendicular to the vertical plane containing the longitudinal axis of the vehicle, and two longitudinal beams 5 which each carry at least two wheels. In use the beams extend longitudinally of the body on both sides of the vertical plane, and they are connected to each other by a rod 12 mounted on ball and socket joints 13.

The longitudinal beams are hinged (9) to the common cross bar such that the wheels carried by the beams may become oriented in order to follow the curves of the track rails 6 and to be moved in order to pass over inequalities or unevennesses of said track.

6 Claims, 9 Drawing Figures

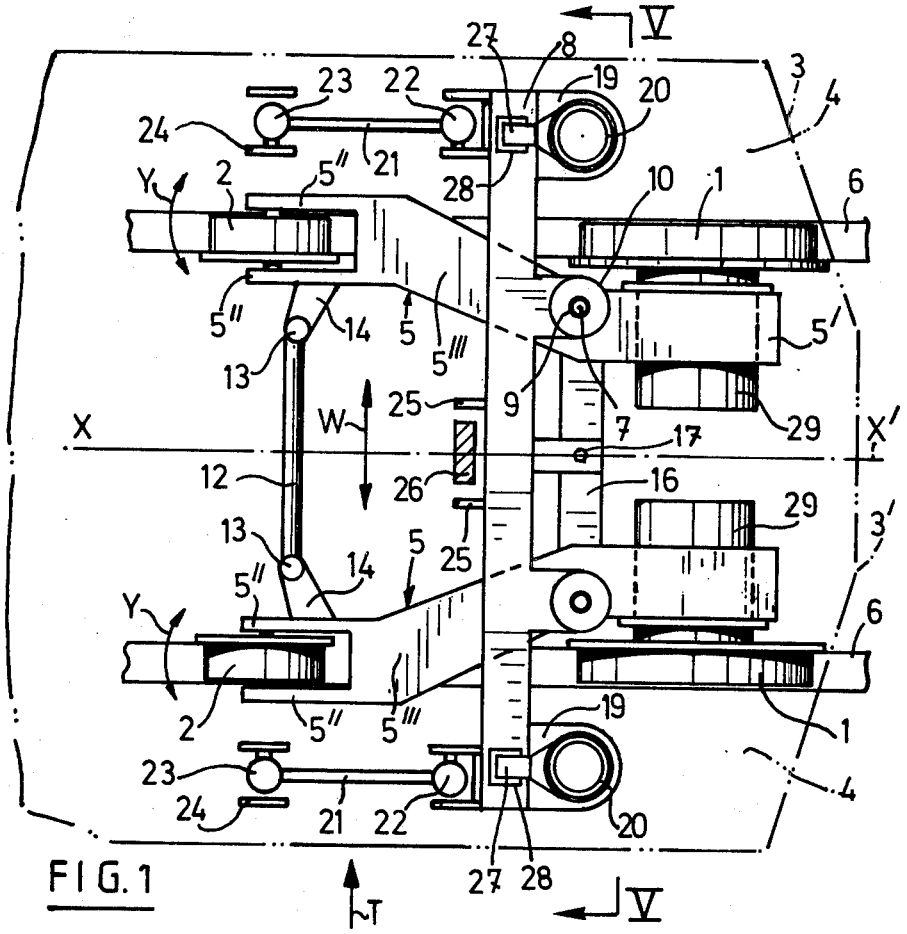
FIG. 1
FIG. 2
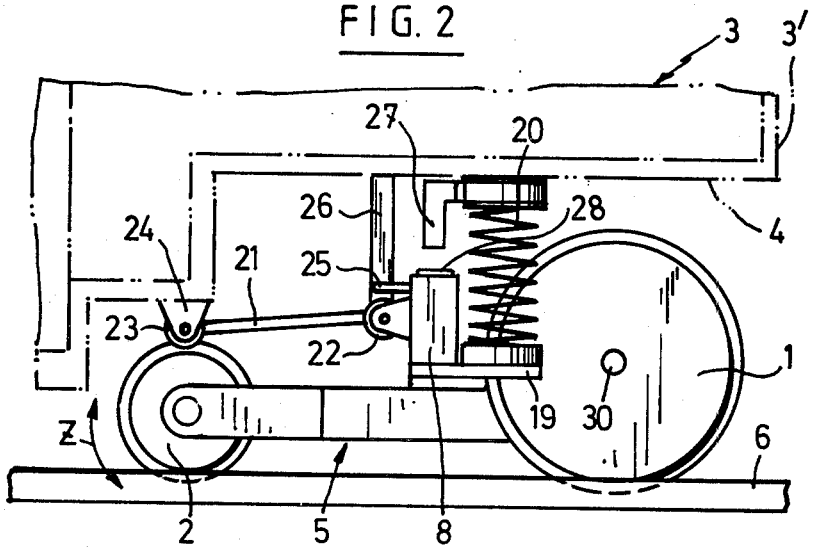

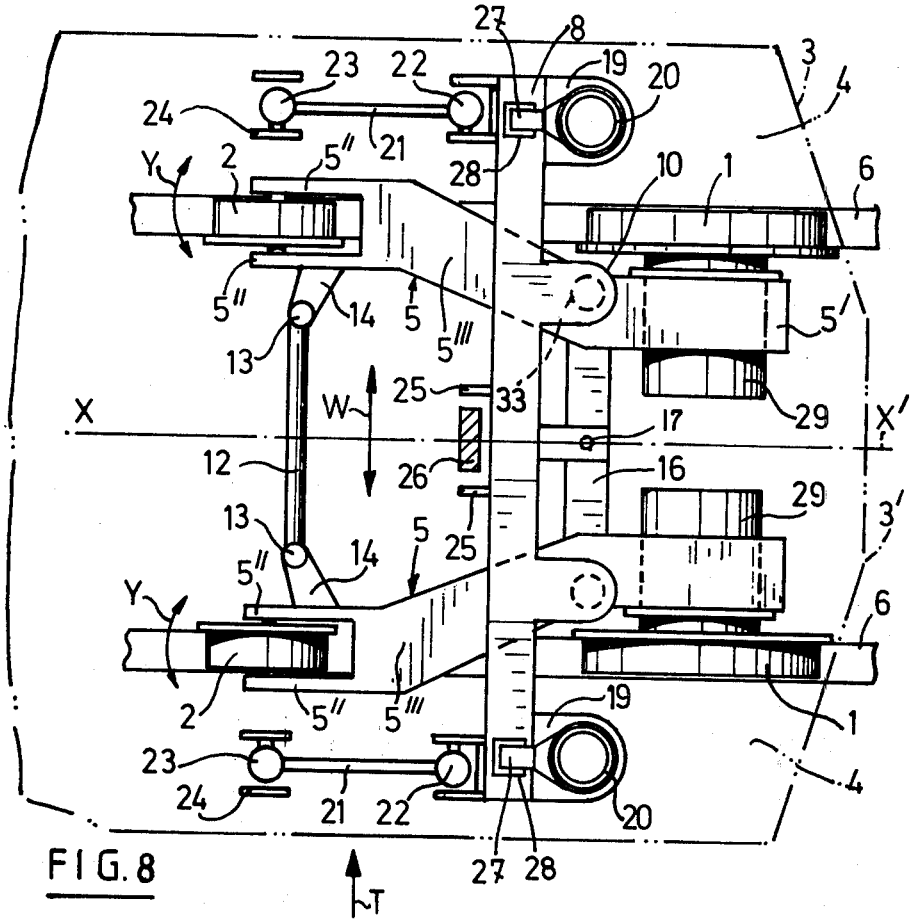
FIG. 8
FIG. 9
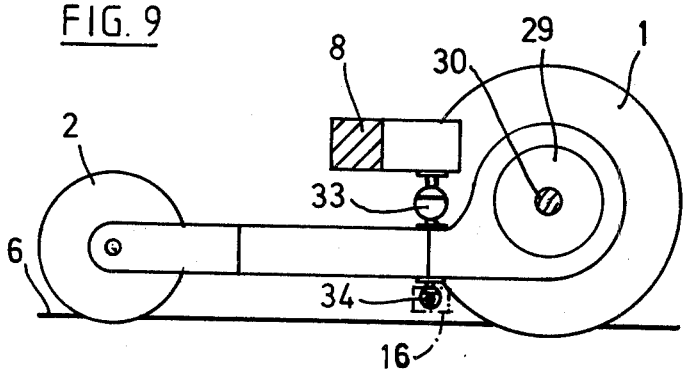

RADIAL TRUCK

PRIOR ART

Many supporting and guiding devices for railway vehicles in which means are provided for maintaining the best possible dynamic stability of the vehicles rolling along rectilinear tracks or rails and for enabling an easy taking of the curves of said tracks or rails are known.

U.S. Pat. No. 3,066,617 discloses a supporting device for railway vehicles, which mainly comprises a pair of movable longitudinal beams which can pivot in a substantially longitudinal plane. These beams may be guided by the rails, while remaining parallel to each other, and may become inclined in a substantially vertical plane due to a cross-member which connects them to each other in the transverse direction.

The main drawback of this known device is that the tilting or inclination of said two longitudinal beams, when the device passes over inequalities or unevennesses of the track, causes a deformation of the components of said device, particularly a torsion of the cross bar.

Moreover, the stresses and deformations of the device cause an unloading of the wheels which increases the derailment risks.

Since the inner deformation of each of the components of the device must remain lower than the elasticity limit, it is obvious that the capacity of the device for passing over track inequalities of unevennesses is limited. The conception and the construction of the device are difficult, due to the risks of concentrations of stresses in the cross bar. In order to avoid as far as possible the permanent deformations and particularly those resulting from the torsion of the common cross bar, said devices must have a sufficient wheelbase for reducing the angular deformations when the device passes over a given inequality, so that said known devices become cumbersome.

BRIEF DESCRIPTION OF THE INVENTION

It is an object of this invention to avoid said drawbacks.

This invention relates to a supporting and guiding device for railway vehicles, comprising at least four wheels mounted on a support intended to be fixed to the body of a vehicle near one end of said body and consisting of a cross bar maintained perpendicular to the vertical plane containing the longitudinal axis of the vehicle and of two longitudinal beams which carry each at least two wheels and which, in the use or work position, extend in the longitudinal direction of the body, on both sides of said vertical plane, said longitudinal beams being possibly connected to each other by a rod mounted on ball and socket joints, said device being mainly characterized in that said longitudinal beams are hinged to the common cross bar such that the wheels carried by the beams may become oriented in order to follow the curves of the track and to be moved in order to pass over the inequalities or unevennesses of said track.

The beams are mounted on hinges carried by the cross bar, so as to be able to pivot about a substantially vertical axis, in the work position of the device and, in a particular embodiment of the device according to the invention, said hinges are adapted so as to allow each beam to become inclined in a substantially vertical plane, in the work position of the device.

According to a feature of the invention, the longitudinal beams are hinged to the common cross bar by pivots which are able to become inclined in a substantially vertical plane, in the work position of the device.

In a particular embodiment, the longitudinal beams are mounted on pivots which are connected to each other by a swingle-bar which is hinged to said pivots by ball and sockets joints and which is connected to the cross bar by a substantially vertical pivot in the work position of the device or by a ball and socket joint.

The beams are advantageously mounted on pivots connected to each other by a swingle-bar and connected to the common cross bar by ball and socket joints, so that said beams may also pivot about their longitudinal axes.

In another particular embodiment, the cross bar is divided in two parts which may pivot with respect to each other about the longitudinal axis of said cross bar.

In a preferred embodiment of the device according to the invention, the longitudinal beams are each, on the one hand, hinged to the cross bar by a ball and socket joint carried by said cross bar and, on the other hand, connected by a second ball and socket joint to a swingle bar which is connected to the cross bar by a substantially vertical pivot in the work position of the device or by a third ball and socket joint.

DETAILED DESCRIPTION OF THE INVENTION

Other features and details of the invention will appear in the following description of the attached drawings which show schematically embodiments of a supporting and guiding device according to this invention.

In the drawings:

FIG. 1 is a plan view of a first embodiment of the device according to this invention;

FIG. 2 is a side view in the direction of arrow T of FIG. 1;

FIGS. 6 to 9 are views similar to those of FIGS. 1 and 2 showing two other embodiments of the device according to the invention.

In the various figures, the same reference numbers designate similar elements.

Figure 3:
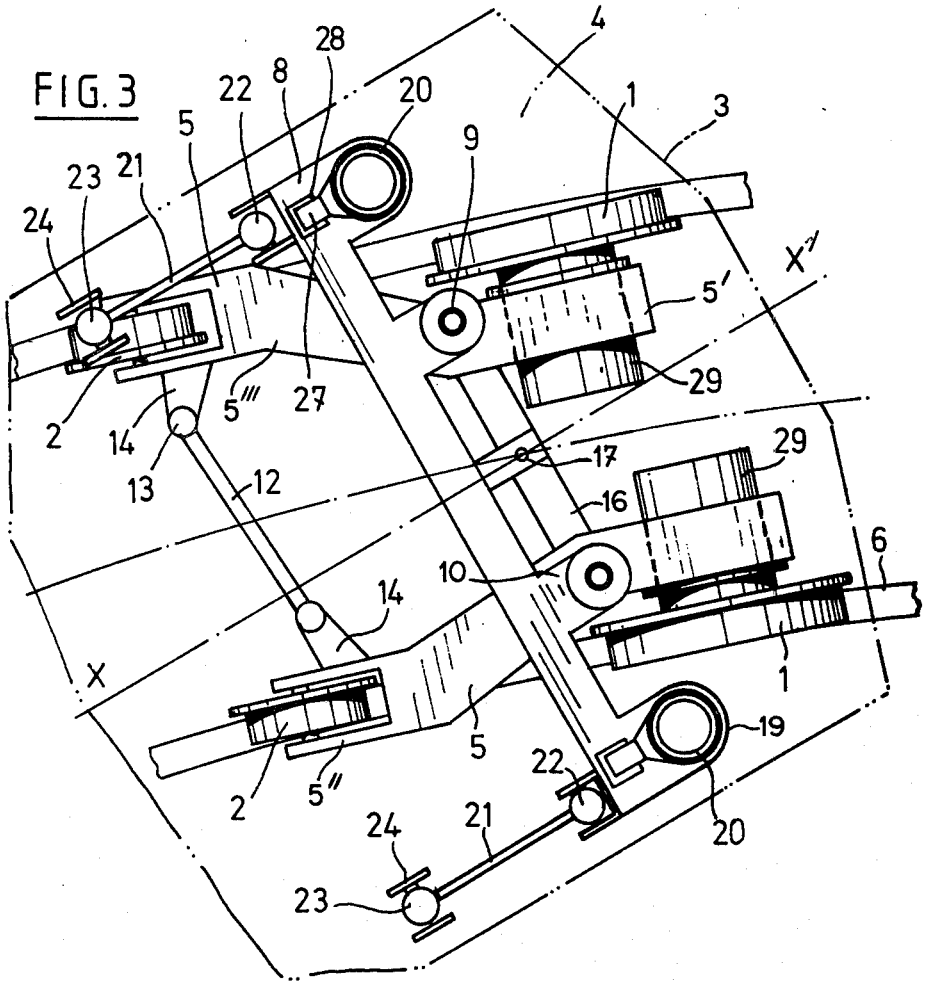
FIG. 3 is a plan view similar to that of FIG. 1, showing the position of the components of the device according to the invention, when it enters into a curve of a railway track.

In a first embodiment, the supporting and guiding device for a railway vehicle, shown in FIGS. 1 to 4, comprises a first pair of wheels 1 having a great diameter and a second pair of wheels 2 of small diameter mounted on a support intended to be attached to a body 3 of a railway vehicle, near one end 3' of said body 3, the bottom 4 of which is shown by a dotted line in FIGS. 1 and 3.

The wheel support comprises two longitudinal girders or beams 5 which, in the work position of the device, extend in the longitudinal direction of the body 3, i.e. in the direction of the longitudinal axis X—X', on both sides of the vertical plane containing said longitudinal axis X—X'. The longitudinal beams 5 have such a shape that the planes of the wheels 1 and 2 carried by each of them are contained in a same substantially vertical plane, whatever the orientation of the beams.

Figure 4:
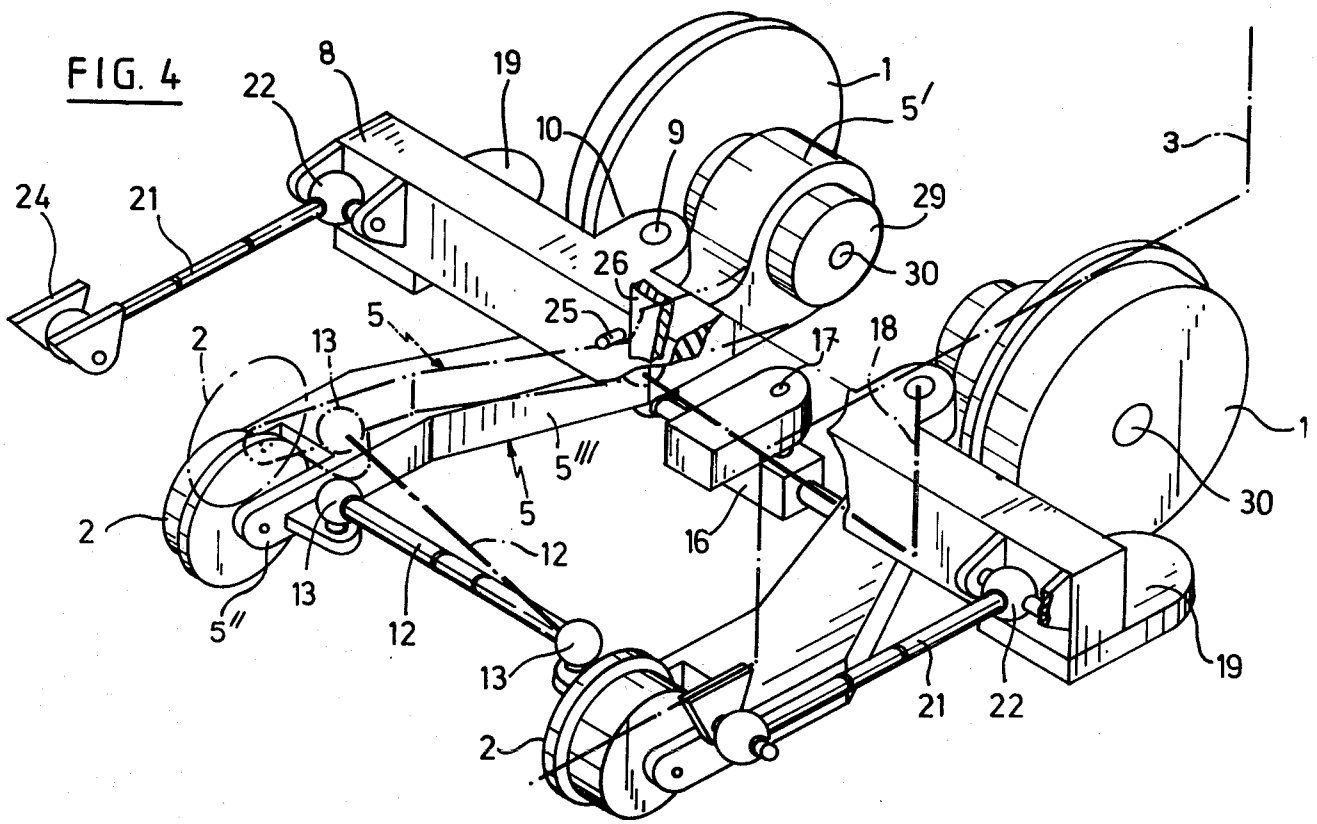
FIG. 4 is a perspective view of the device shown in FIG. 1 showing different positions of the components or parts of the device.

As shown by FIGS. 1, 3 and 4, the wheels 1 having a great diameter which are supporting wheels, possibly operated by a motor, are mounted on the outside near one end 5' of the longitudinal beams 5, whereas the wheels 2 having a small diameter, which are guiding wheels, are mounted in a fork 5'' at the other end of the longitudinal beams 5. The end parts 5' and 5'' of the beams 5 are integral with an intermediate oblique part 5''' of the latter.

It is obvious that the longitudinal girders or beams 5 may have a shape which is different from that shown in FIGS. 1, 3 and 4 and may, for example, be rectilinear. In the latter case, the wheels 1 and 2 are mounted on the same side of the longitudinal beams 5. The wheels 1 and 2 may also have the same diameter.

In use, the wheels 1, 2 are supported by tracks or rails 6.

Each longitudinal beam 5 is hinged at point or axis 7 to a cross bar 8, so that the longitudinal beams 5 may, on the one hand, pivot in the direction of arrows Y (see FIG. 1) and, on the other hand, become inclined in the direction of arrows Z (see FIG. 2). Thus, the longitudinal beams 5 are mounted on pivots 9 carried by side bosses 10 of the cross bar 8. The pivots 9 may become inclined in a substantially vertical plane about axes 11 which are parallel to the longitudinal axis of the cross bar 8, so that the longitudinal girders 5 may themselves become inclined in the direction of the arrows Z. Moreover, the pivots 9 also allow a pivoting of the longitudinal beams 5 in the direction of the arrows Y. Due to the pivoting and inclining movements of the longitudinal beams 5 with respect to the cross bar 8, a correct orientation of the wheels 1 and 2 is obtained in the curves of the track 6 (see FIG. 3) and a permanent contact is obtained between the wheels 1, 2 and the track 6, whatever be the variations in the levels of the rails.

The pivots 9 may advantageously be replaced by a ball and socket joint which allows not only a pivoting in the direction of arrows Y and an inclination in the direction of arrows Z, but also a pivoting of the longitudinal beams 5 about their longitudinal axis.

As shown in FIGS. 1 to 5, the longitudinal beams extend below the cross bar 8.

FIGS. 1 to 3 show a rod 12 carrying ball and socket joints 13 and connected to pieces 14 attached to the longitudinal beams 5. The rod 12 is horizontal when the rails 6 are at the same level. When the rails are both rectilinear and at the same level, the rod 12 is perpendicualr to the two longitudinal beams 5. When the track 6 is curved, while remaining at the same level, said rod 12 extends in an oblique direction with respect to the longitudinal beams 5. When the rails 6 are at different levels the rod 12 is inclined to the horizontal. Various positions of the rod 12 are shown by continuous lines and dotted lines in FIG. 4.

As shown in FIGS. 1 and 3, the pivot 9 of each longitudinal beam 5 is mounted between the axes of the wheels 1, 2 provided at the opposite ends of the beam, so that the beams 5 operate, in fact, as levers which are capable of pivoting and becoming inclined with respect to the cross bar 8.

Figure 5:
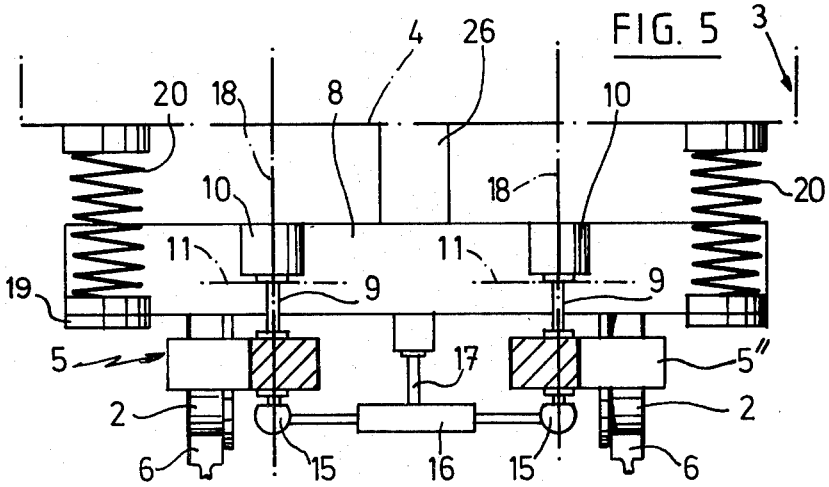
FIG. 5 is an end view after section along the line V—V of FIG. 1.

FIG. 5 shows that the pivots 9 of the longitudinal beams 5 are hinged, at one end, about the axes 11 which are attached to the cross bar 8, whereas at their opposite end said pivots 9 are hinged by means of ball and socket joints 15 to a swingle bar 16 having a vertical pivot 17 attached to the cross bar 8. This swingle bar 16 maintains the axes 18 of the pivots 9 in substantially vertical planes, while enabling said axes to become inclined in these vertical planes.

At each end, the cross bar 8 is provided with a side or lateral boss 19 which acts as a bearing for a coil spring 28 connecting the cross bar 8 to the bottom 4 of the vehicle body 3 (FIG. 2). On the opposite side of the cross bar 8 a rod 21, provided at one end with a first ball and socket joint 22 fixed to the cross bar 8 and at its opposite end with a second ball and socket joint 23 fixed to a piece 24, is connected to the bottom 4 of the vehicle body 3.

Such connecting structures allow a lateral displacement, in the direction of arrows W, of the cross bar 8 with respect to the body 3. This displacement is limited by at least one stop 25 which is carried by the cross bar 8 and may come into contact with a piece 26 fixed to the vehicle body 3. The compression of the coil springs 20 is limited by stops 27 which may come into contact with the cross bar 8 or a bearing piece 28 fixed to said cross bar 8.

The structures connecting the cross bar 8 to the vertical body 3 may also comprise buffers or dash pots not shown in the drawings.

The supporting and guiding device shown in FIGS. 1 to 3 is motorized by connecting individually each large diameter wheel 1 to a motor-reduction gear unit 29 attached to a longitudinal beam 5, the wheel 1 being locked on the outlet shaft 30 of said unit 29.

Figure 6:
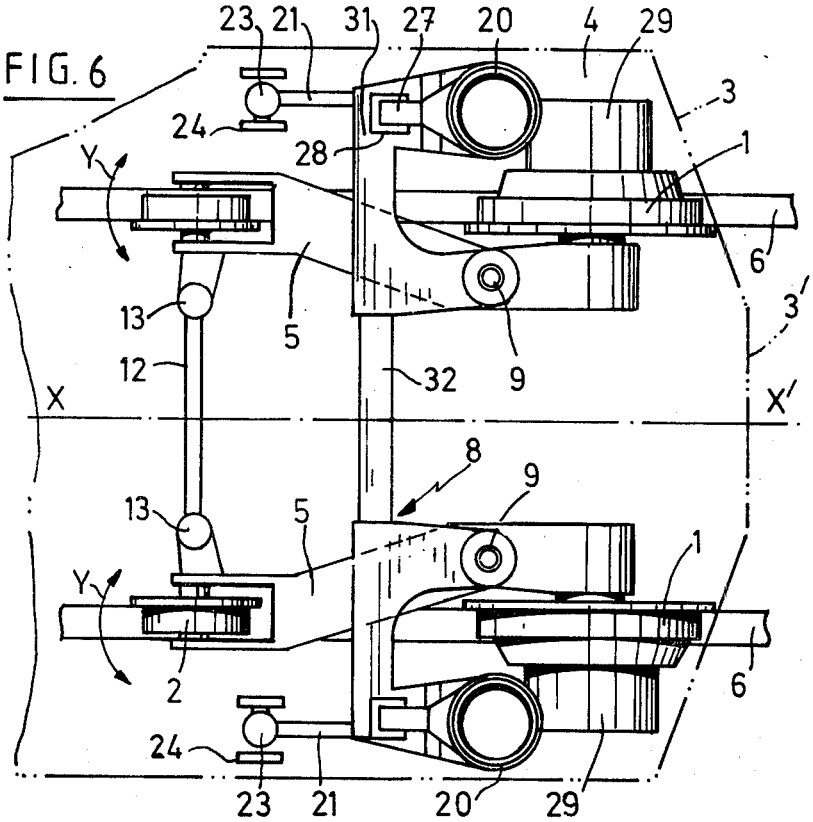
Figure 7:
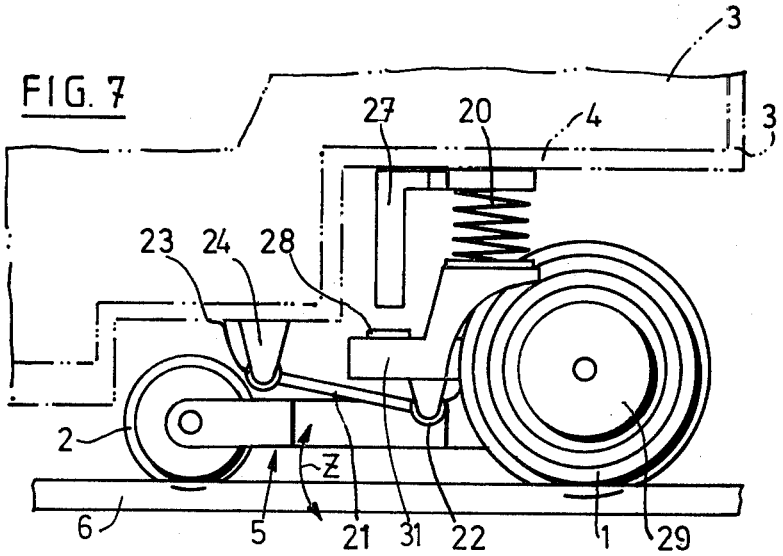

In a second embodiment of the invention shown in FIGS. 6 and 7, the cross bar 8 comprises two parts 31 having substantially a U-shape, which may be inclined in respect of each other about a rod 32 in the direction of the arrows Z (see FIG. 7), said rod 32 connecting to each other the bottom part of the U-shaped pieces 31. Longitudinal beams 5 carrying each two wheels 1, 2 are connected to the pieces 31 by pivots 9 attached to each piece 31 and capable of being inclined together with said pieces 31 in the direction of the arrows Z. The longitudinal beams 5 may also pivot about said pivots 9 in the direction of the arrows Y.

Coil springs 20 connect elastically each piece 31 of the cross bar 8 and the bottom 4 of the vehicle body 3.

In this embodiment the axes of the coil springs 20 are in line with the points of attachment of the pivot 9 on each piece 31, when the longitudinal axis of the beams 5, in the work position of the device on a track length without level variation, are contained in a substantially horizontal plane. However, for reasons of construction, the bearing points of the springs 20 may be displaced with respect to the line of pivots 9.

As indicated before, the rod 12 connects the longitudinal beams 5 to each other by means of ball and socket joints 13 and ensures a coupling of the movements of said longitudinal beams 5.

As in the first embodiment, a rod 21 provided at one end with a first ball and socket joint 22 attached to each piece 31 of the cross bar 8 is connected, at its opposite end, to the bottom 4 of the vehicle body 3 by means of a second ball and socket joint 23.

The supporting and guiding device according to this invention may be provided with auxiliary equipments, such as motors, disc brakes, magnetic shoe brakes on rails, stop means against derailments and the like.

The supporting and guiding device according to this invention has many advantages. The weight of the device is small. The space required for the device is small so that the level of the vehicle bottom with respect to the track may be small, the access of the vehicle being therefore easier and the gauge reduced.

Since it is kinematically deformable, the conception and construction of the device are easy, since it only needs simple and common assembling pieces.

The kinematics of the device according to this invention allow deformations without stresses or antagonistic efforts. Thus, the distribution of the loads between the wheels is practically not influenced by outer factors, such as the cant, the inequalities or unevennesses of the track and the movements of the vehicle body. This improves the dynamic stability and reduces derailment risks. Moreover, the noise and the wear of the wheels and of the rails in the track curves are reduced.

The invention is obviously not limited to the above described details for causing the longitudinal beams to pivot and become inclined.

Thus, instead of being each hinged to the cross bar 8 by a pivot 9, the longitudinal beams 5 may be hinged to the cross bar 8 by a first ball and socket joint 33 carried by said cross bar 8 and maintained in place by a second ball and socket joint 34 attached to the swingle bar 16 which is attached to the cross bar 8 by a substantially vertical pivot 17 in the work position of the device or by a third ball and socket joint (FIGS. 8 and 9).

We claim:

1. A supporting and guiding device for a railway vehicle, comprising:

(a) a cross bar (8) disposed transverse to a longitudinal axis (X—X') of a railway vehicle, (b) a pair of spaced longitudinal beams (5), (c) a pair of track engaging wheels (1, 2) individually and rotatably mounted to opposite ends of each beam, (d) a transversely oriented rod member (12), (e) a first pair of ball and socket joints (13) individually connecting opposite ends of the rod member between and to the beams at one end thereof, (f) a pair of pivotable hinge means (9) carried by the cross bar individually mounting the beams to the cross bar intermediate the ends of the beams, (g) a transversely oriented, elongate swivel bar (16), (h) a second pair of ball and socket joints (15) individually connecting opposite ends of the swivel bar to lower sides of the beams below the hinge means, and (i) vertical pivot means (17) connecting a mid-point of the swivel bar to the cross bar, whereby the wheels may freely orient themselves to follow curvatures of the track and to pass over inequalities and unevennesses of the track.

2. A device according to claim 1, wherein the hinge means each comprises a first vertically disposed rod (9) journalled in and extending downwardly through an associated beam, and a pivotable coupling between the cross bar and an upper end of said rod.

3. A device according to claim 2, wherein the pivotable coupling is a ball and socket joint.

4. A device according to claim 3, wherein the vertical pivot means (17) comprises a second vertically disposed rod extending upwardly from the swivel bar, and a ball and socket joint coupling the cross bar to an upper end of the second rod.

5. A device according to claim 1, wherein the hinge means each comprises a ball and socket joint.

6. A device according to claim 5, wherein the vertical pivot means (17) comprises a vertically disposed rod extending upwardly from the swivel bar, and a ball and socket joint coupling the cross bar to an upper end of the rod.

* * * * *